US008893413B1

(12) United States Patent
Shepard

(10) Patent No.: US 8,893,413 B1
(45) Date of Patent: Nov. 25, 2014

(54) DEVICE AND METHOD FOR PRESENTING TWO IMAGES HAVING DIFFERENT PERSPECTIVE VIEWS TOGETHER

(75) Inventor: William Gray Shepard, Seattle, WA (US)

(73) Assignee: William Gray Shepard, Seattle, WA (US)

( * ) Notice: Subject to any disclaimer, the term of this patent is extended or adjusted under 35 U.S.C. 154(b) by 43 days.

(21) Appl. No.: 13/602,565

(22) Filed: Sep. 4, 2012

Related U.S. Application Data

(60) Provisional application No. 61/535,090, filed on Sep. 15, 2011.

(51) Int. Cl.
*G09F 19/14* (2006.01)

(52) U.S. Cl.
USPC ..... 40/453; 40/503

(58) Field of Classification Search
USPC ..... 40/453, 503
See application file for complete search history.

(56) References Cited

U.S. PATENT DOCUMENTS

| | | | | | |
|---|---|---|---|---|---|
| 3,406,476 | A | * | 10/1968 | Wilcox | 40/430 |
| 4,233,767 | A | * | 11/1980 | Hryhorczuk | 40/453 |
| 4,422,253 | A | * | 12/1983 | Babberl | 40/453 |
| 4,937,960 | A | | 7/1990 | Otake | |
| 5,598,650 | A | * | 2/1997 | Brown | 40/453 |
| 6,306,479 | B1 | | 10/2001 | Feiertag | |
| 7,356,953 | B2 | | 4/2008 | Davis | |

* cited by examiner

*Primary Examiner* — Casandra Davis
(74) *Attorney, Agent, or Firm* — Stan Collier, Esq.

(57) ABSTRACT

An art kit provides an artwork having two complementary pictures such that the viewing angle determines a resulting picture. A pair of sheets has complementary images thereon, a left hand image and a right hand image as defined. Each sheet is separable into a plurality of strips with tabs on each side that can be folded. Each strip of each sheet may be numbered evenly and oddly in sequence. The sequential numbers such as 1 and 2 are connected with vertical tabs being held together with clips to form one section of the two images, one side being left and the other right. All of the sections are then mounted to a backing board frame to form the artwork. If the sheets are without printed images, an artist may form such images on the sheets when the sheets are mounted in a coloring jig before separation.

12 Claims, 7 Drawing Sheets

DEVICE AND METHOD FOR PRESENTING TWO IMAGES HAVING DIFFERENT PERSPECTIVE VIEWS TOGETHER

CROSS-REFERENCES TO RELATED APPLICATIONS

This is the utility patent application for Provisional Patent Application 61/535,090, filed on Sep. 15, 2011, by the same inventor.

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

1. Field of the Invention

The present invention relates generally to art as presented by pictures/images, and, in particular, relates to combining two pictures/images to have a different overall image from different perspective views, and, in greater particularity, relates to a kit and method of using the kit which allows users to blend two separate complimentary images together into one artwork.

2. Description of the Prior Art

Art forms are clearly an evolving process dependent upon the artist's creative imagination, the medium of presentation, and the technology available. Integrating two pictures or images in one frame has been addressed as shown by the prior art and has been described as "kinetic art."

Artist Yaacov Agam popularized this art-form in the 1950's. Many artists have utilized this principle in their art as well since then. In the 1980's one such artist Shirley Chaitlin used extruded plastics to create an articulated art-form that she called an "Articulator." Many artist have attempted new approaches to this art-form with varying levels of success, using wood, metals, glass and plastics as well as folded paper.

In 1999 inventor Alan Feiertag filed a patent application regarding "Kinetic Art Paper" that resulted in an issued patent, U.S. Pat. No. 6,306,779, that is incorporated by reference. The purpose was intended for making what is called "kinetic art" with the aid of a photoprinter and a computer assisted printing programs that are now available. In this process of Feiertag, a kinetic artwork paper is formed on a backing sheet with multiple strips of paper adhered thereto with cutouts therebetween so that the artwork paper can be folded in pleats. As noted, pictures can be placed on the strips manually or in a preferred embodiment by photoprinting with a special program now available for integrating two pictures thereon. Alternating strips would have one image and the other strips would have the other image. After forming the integrated image on the artwork paper, it is then folded into pleats so that, as seen from straight on, one image is on the left side of the pleats, and the other image is on the right side of the pleats.

U.S. Pat. No. 4,937,960, being incorporated by reference, discloses a process of placing multiple pictures upon a backing sheet automatically. The backing sheet with two applied pictures is then attached to a display stand being shaped as a triangular prism shaped body. A wavelike display surface is attached to each side of the prism body and then the two pictures on the backing sheet are placed on the wavelike body so that two different pictures can be seen if looking in different directions as the display stand is rotated to the side. Therefore, 6 different pictures are viewable on this display stand as it is rotated. This process is thus a means of increasing the number of pictures as seen, for example, on a three sided, rotating display to six.

U.S. Pat. No. 7,356,953 discloses a process of forming a display assembly for including two picture displays in a book where the two pictures are included upon a folded pleated kinetic artwork insert. This reference is incorporated by reference.

Accordingly, there is an established need for a process where a user/artist is able to easily form "kinetic art" by using a kit having an improved process therein.

SUMMARY OF THE INVENTION

The present invention is directed at a kit and method of using the kit that allows the user to blend two separate complimentary images together into one artwork.

In the present invention, a kit with accessories provides a means for producing an artwork having two complementary pictures/images thereon such that the viewing angle of the viewer determines a resulting picture. In the kit, a pair of sheets has "complementary" images thereon. The images are complementary in that one image, such as a green forested scene, turns into another image, a snow covered forested scene. The different images need not be of a similar nature. One sheet having a left side image and the other sheet having a right side image as defined herein. Each sheet is separable into a plurality of strips, one sheet being left sided and the other right sided images, with tabs on each side of the strips these can be folded about the strip for mounting. Each strip of each sheet may be numbered evenly and oddly in sequence. The sequential numbers such as 1 and 2 on the strips, 1 being on the left and the 2 being on the right, are connected with vertical tabs being held together and glued with plastic clips to form a section of the two images, one side being left and the other right on a wedge shaped section. All of the sections so formed are then mounted to a backing board frame to form the artwork of the two complementary images. If the sheets do not have pre-designed complementary images which can be selected by a user, an artist may form such images on the sheets when the sheets are mounted in a coloring jig before separation as described herein.

An object of the present invention is to provide an artwork having a variable appearance dependent upon the position of the viewer.

It is another object of the present invention to provide a kit for a user/artist that allows the formation of a unique artwork.

It is a further object of the present invention to provide a kit with a minimum of parts that allows a user/artist to produce a unique artwork with a minimum of training.

It is still a further object of the present invention to provide a kit that produces a unique artwork at a minimum expense.

It is yet a further object of the present invention to provide a kit that is relatively inexpensive but allows for the creation of unique artwork.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Figure 1:
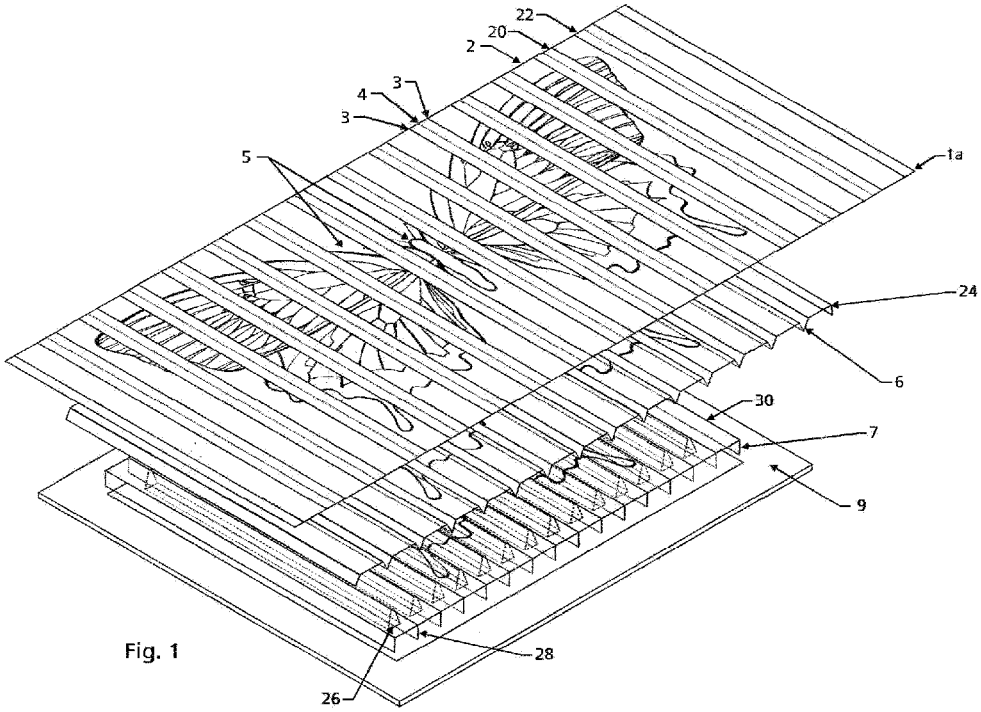
FIG. 1 is a perspective view illustrating one of two complimentary pictures showing one printed and die-cut picture in three different phases of production of a preferred embodiment of the present invention.

The present invention is directed at artwork made with the use of a kit that allows the user to blend two separate complimentary images together into one artwork.

The present invention provides users with an artwork kit utilizing a unique pleated die-cut paper design which at one step divides into multiple strips which are glued together and attached to a backing board frame to create a fanfold like device that may be easily made and assembled by even a child. Images may come pre-printed on the die-cut paper with multiple vertical score lines for holding a sharp fold and multiple perforated strips for separation once the coloring or painting of the two separate yet complimentary images is complete. The kit may come with two separate yet complimentary printed die-cut sheets that fold along multiple vertical score lines and are held tightly in place by a series of plastic binder clips. The plastic binder clips also hold the pleated paper together in a uniform flat coloring surface that, when assembled, fit down into a simple cardboard holder creating the coloring jig. The artist then paints or colors the two separate complimentary images before removing the sheets from the coloring jig if they do not come with pre-printed images. The artist removes the binder clips then tears along the perforated lines. The artist then fits one by one the two now separated corresponding numbered images together using glue and the same plastic binder clips. Once the corresponding colored numbered paper strips are all properly glued together forming one triangular prism shaped section, the artist then glues them one by one to the provided backing board frame in such a way as to create one unified fanfold like artwork.

Different materials and widths may be utilized in the making of the artwork kit. A medium weight paper with the designation of 80 to 100 lbs. allows for multi-media use and is the preferred weight for folding and maintaining a more rigid fanfold shape. The die-cut paper when torn along the multiple vertical perforated lines are of uniform dimension. They are scored and easily folded into two places creating two tabs one on each side of the image strip. The two tabs should be the same width and the combined width of the two tabs should not be greater than the width of the image strip. The same plastic binder clips are later used to glue the two complimentary strips together once they are complete and separated by tearing along the multiple vertical perforated lines. A double sheet of corrugated cardboard with the center cut out to size helps hold the artwork in place while the artist colors or paints the surfaces of the image strip.

The backing board frame is ridged and is comprised of two four-ply sheets of mat board. The top mat board has a window cut out of the center with the same measurements as the strips when attached together and also has several inches of edging of board to provide for aesthetic effect. The bottom mat board has a series of vertical lines to guide and aid the placement and gluing of the joined and folder paper strips. The two mat boards that come joined together create a nest or through that acts as a guide to help the artist glue the joined and number strips one by one squarely into place.

When the complementary images are united into one unified composition, the image blends and transforms into another when the viewer passes from one side to the other side of the artwork. The artwork kits may come with pre-designed images for easy coloring as needed as well as blank kits for the artist to create their own designs. The art-form is particularly good in depicting many transformational effects such as winter transitioning into spring or a dancer turning into a butterfly, for instance.

In greater detail, the kit with accessories provides a means for producing an artwork having two complementary pictures/images thereon such that the viewing angle of the viewer determines a resulting picture. In one version of the kit, a pair of die-cut sheets has "complementary" images thereon. The images are complementary in that one image, such as a green forested scene, turns into another image, a snow covered forested scene, or similar. The different images need not be of a similar nature. One die-cut sheet has a left side image and the other sheet has a right side image as defined herein. Each die-cut sheet is separable into a plurality of strips, one sheet being left sided and the other right sided images, with tabs on each side that can be folded about the strip for mounting. Each strip of each sheet may be numbered evenly and oddly and in sequence. The sequential numbers such as 1 and 2 on the strips, 1 being on the left and the 2 being on the right, are connected with vertical tabs being held together and glued with plastic clips to form a triangular prism shaped sections of the two images, one side of the prism face being left and the other right side on the prism shaped section. All of the sections so formed with appropriately numbered strips are then mounted to a backing board frame to form the artwork of the two complementary images. If the sheets do not have pre-designed complementary images which can be selected by a user, an artist may form such images on the sheets when the sheets are mounted in a coloring jig before separation as described herein.

In much greater detail, turning to the drawings, wherein like components are designated by like reference numerals throughout the various figures, attention is initially directed to FIG. 1 that is a perspective view illustrating one of two complimentary pictures, the first being a butterfly, showing one printed and die-cut sheet 1*a* in three different phases of production of a preferred embodiment of the present invention.

In the top position of FIG. 1, the die-cut sheet 1*a* is composed of strips 2 with images on them, 5 and 6. The tabs 20 and 22 are on each side of the strips 2 with score and fold lines 3 between the tabs and the strips. Between each tab, when adjacent to one another, there is a perforated tear line 4. The next step, sheet 24 shows the tabs being folded together. In step 3, once together, binder clips 26, shown in outline, are placed over the folded tabs 28. At this point, the die-cut sheet 30 is placed into the coloring jig 9. If there was no image on the strips, the strips being all in the same plane now, the artist can paint an image onto the strips. These strips 2 may thus be considered the left side as will be further shown below.

Figure 2:
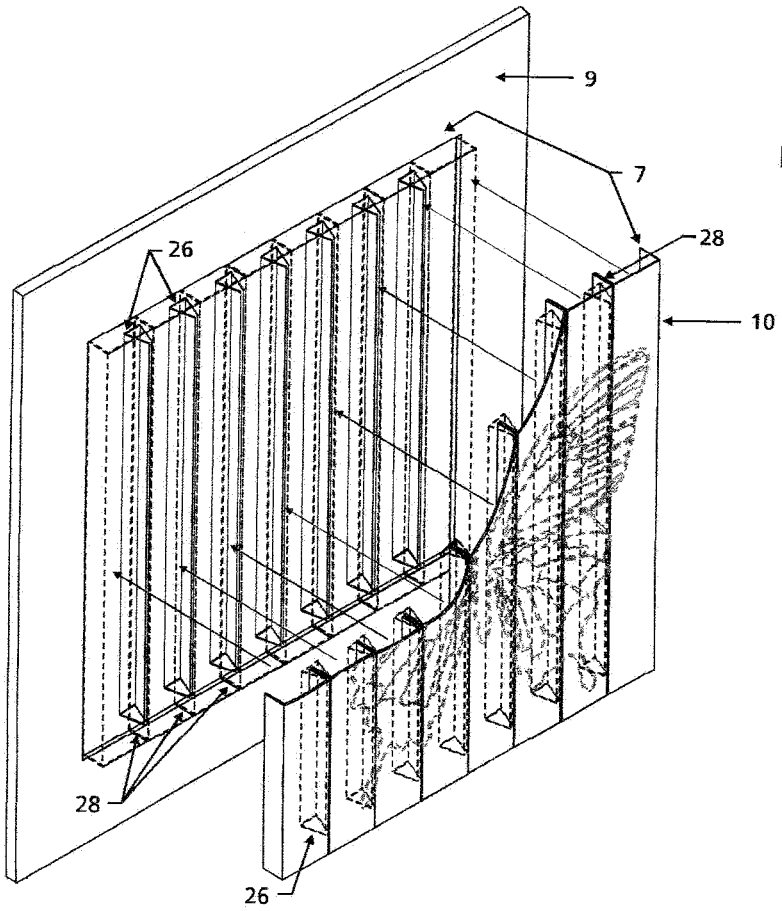
FIG. 2 is a perspective view illustrating one of two complimentary pictures showing one printed and die-cut picture in the third phase of production wherein a plurality of binder clips hold a plurality of vertical tabs together when placed in a coloring jig of the present invention.

FIG. 2 is another perspective view illustrating one of two complimentary pictures showing one printed and die-cut sheet 10 being the left side picture in the third phase of production wherein the plurality of binder clips 26 hold a plurality of vertical tabs 28 together when placed in a coloring jig 9 of the present invention.

Figure 3:
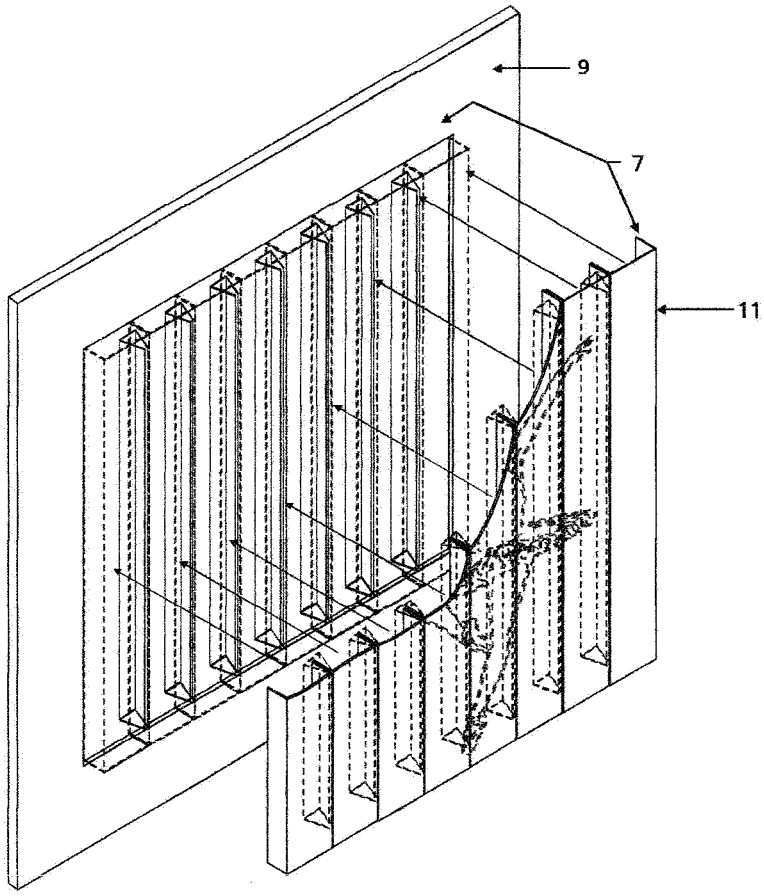
FIG. 3 is a perspective view illustrating the other complimentary picture of two showing one printed and die-cut picture in the third phase of production as in FIG. 2 indicating how the pleated paper folds inward on tabs and each is held tightly by binder clips holding a plurality of strips together when placed in a coloring jig of the present invention.

FIG. 3 is a perspective view illustrating the other complimentary die-cut sheet 11 with a picture thereon of a dancer in the third phase of production as in FIG. 2 indicating how the pleated paper folds inward on tabs 28 and each is held tightly by binder clips 26 holding a plurality of vertical tab together when placed in a coloring jig 9 of the present invention. The difference being it is the right side picture and it is on the right side medium or die-cut paper.

Figure 4:
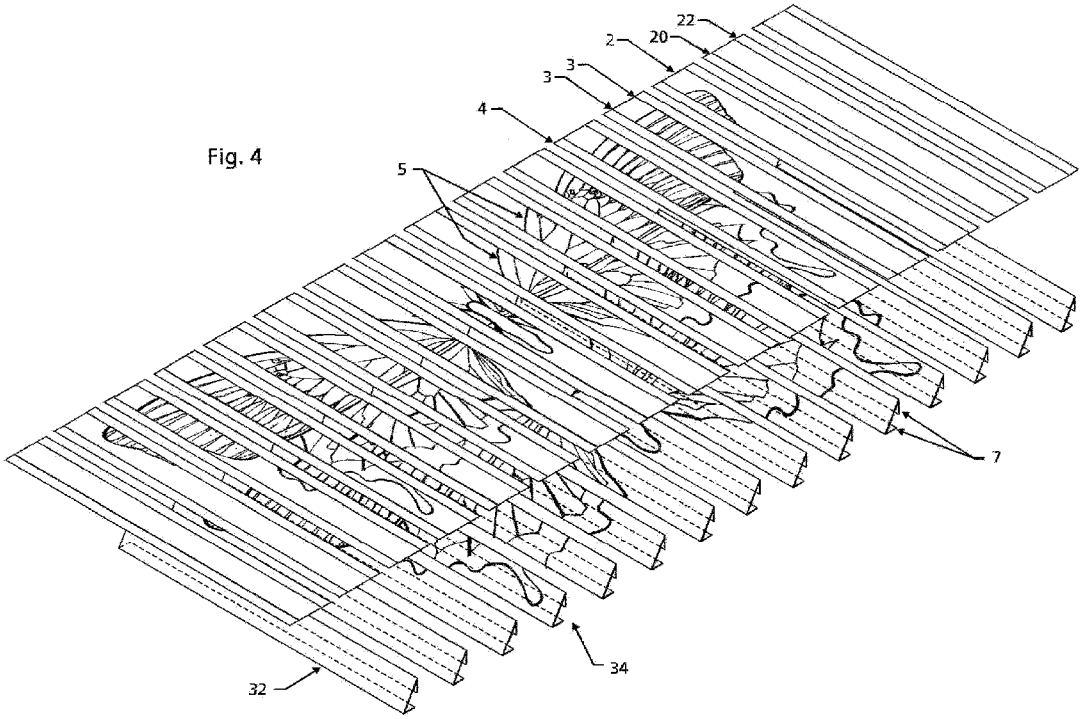
FIG. 4 by perspective view illustrates one complementary picture sheet being composed of a plurality of separated strips with two tabs on each strip wherein the tabs are partially folded about the strip and thereafter placed on a backing board frame forming the left side of the present invention; the right side having a different picture is similarly formed.

FIG. 4 by perspective view illustrates the left side complementary picture sheet of FIG. 1 after separating each strip 2 with adjacent tabs 20 and 22. FIG. 4 shows, in a second step 32, a plurality of separated strips 34 with two tabs 7 on each strip 34 wherein the tabs 7 are partially folded about the strip 34 and thereafter placed on a backing board frame, a nested backing board frame 14, FIG. 7, forming the left side of the present invention; the right side having a different picture is similarly formed except the strips are leaning the other way as a mirror image as shown hereinafter.

Figure 5:
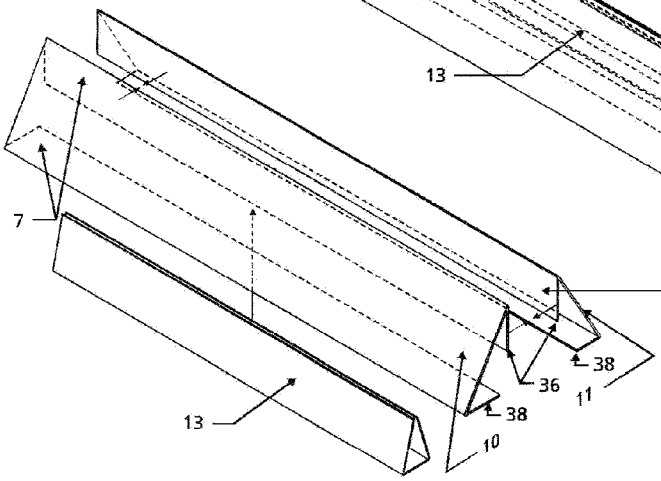
FIG. 5 by perspective view illustrates two sides, a left and a right side, strips with tabs, one tab being vertical and the other being horizontal, before the attachment of the vertical tabs together with the use of a plastic binder clip of the present invention.

FIG. 5 by perspective view illustrates two sides, a left side strip 10 and a right side strip 11, with tabs, one tab being a vertical tab 36 and the other being a horizontal tab 38, before the attachment of the vertical tabs 36 together with the use of a plastic binder clip 13 of the present invention.

Figure 6:
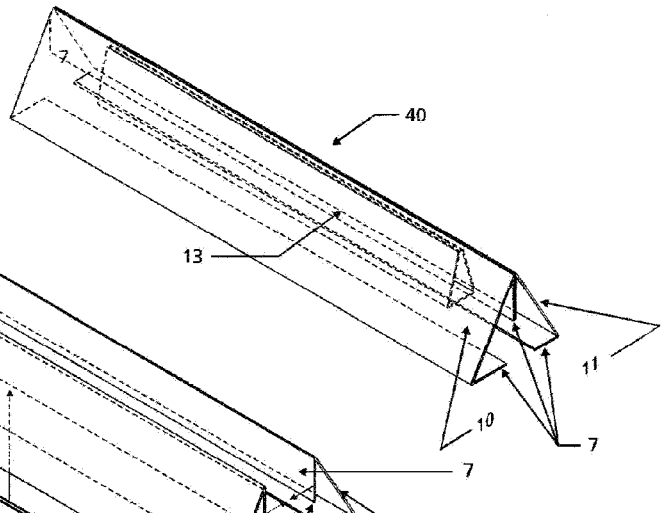
FIG. 6 by perspective view illustrates two sides of FIG. 5, a left and a right side, strips with tabs, one tab being vertical and the other being horizontal, being attached by the vertical tabs with the use of a plastic binder clip of the present invention forming a single section of the complementary pictures.

FIG. 6 by perspective view illustrates the two sides 10 and 11 of FIG. 5, a left and a right side 10 and 11, respectively, strips with tabs, one tab being vertical tab 7 and the other tab 7 being horizontal, being attached by the vertical tabs with the use of a plastic binder clip 13, shown in outline, of the present invention forming a single triangular prism shaped section 40 with the complementary pictures.

Figure 7:
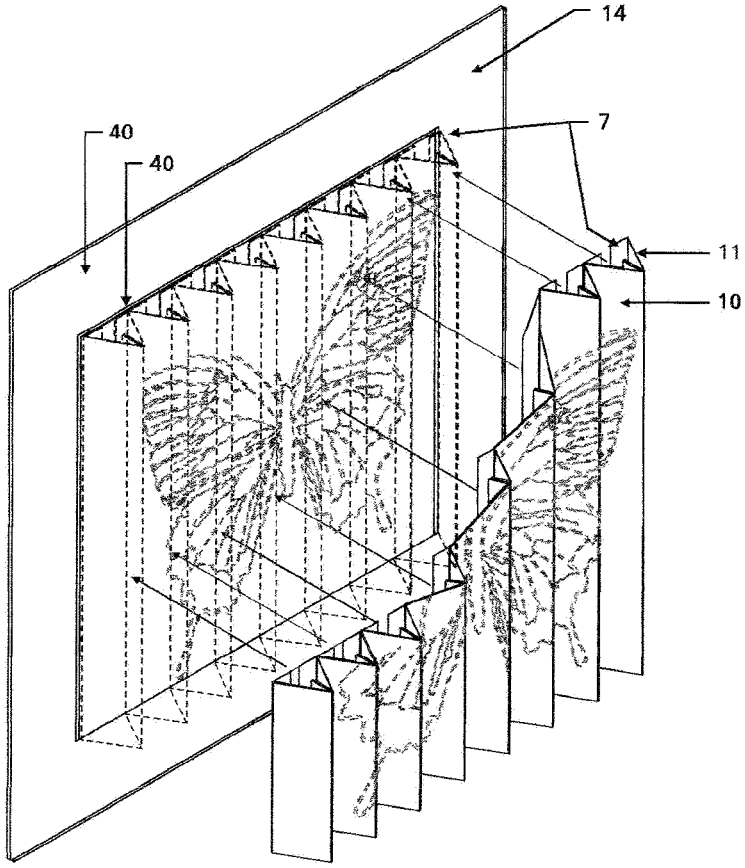
FIG. 7 by perspective view illustrates a plurality of the single sections of FIG. 6 placed side by side on a nested backboard frame acting as a placement guide for mounting and gluing a finished artwork down to the backing board frame of the present invention.

FIG. 7 by perspective view illustrates a plurality of the single sections 40 of FIG. 6 placed side by side on a nested backboard frame 14 acting as a placement guide for mounting and gluing a finished artwork down to the backing board frame 14 of the present invention. The backing board frame 14 may consist of two layered matt boards with a window cut out of the top matt board to accept the sections 40 and the lower matt board marker to aid in the placement of the sections 40.

Figure 8:
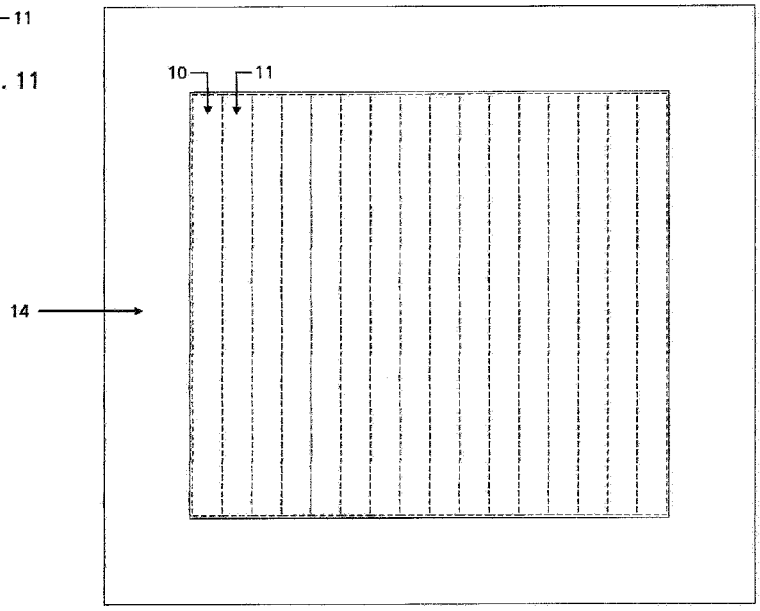
FIG. 8 by perspective view illustrates by a front view the section mounted in the backboard frame, each odd vertical dotted line being a peak, and each even vertical dotted line being the bottom valley, the left and the right side, being one strip each, of the triangular peak having complementary pictures thereon mounted to the backing board frame of the present invention.

FIG. 8 by a front view the sections 40 mounted in the backing board frame 14, each odd vertical dotted line being a peak of the prism, and each even vertical dotted line being the bottom valley, the left and the right side strips 10 and 11, meet together to form the triangular peak having complementary pictures thereon mounted to the backing board frame of the present invention.

Figure 9:
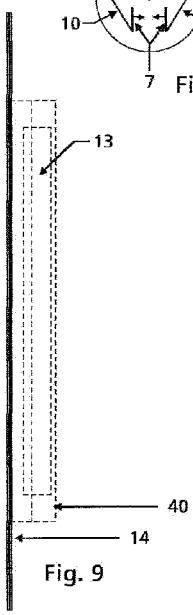
FIG. 9 illustrates by a left side view of FIG. 8 showing the binder clip therein of the present invention.

FIG. 9 illustrates by a left side view of FIG. 8 showing the binder clip therein of the present invention.

Figure 10:
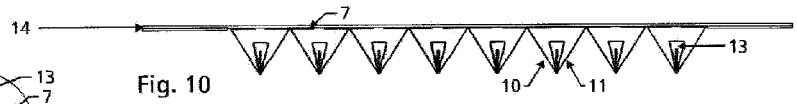
FIG. 10 illustrates by a top plan view of FIG. 8 showing the binder clips on the tabs of each section and the sections glued to the nested backing board frame of the present invention.

FIG. 10 illustrates by a top plan view of FIG. 8 showing the binder clips 13 on the vertical tabs of each section 40 and the sections glued to the nested backing board frame 14 of the present invention.

Figure 11:
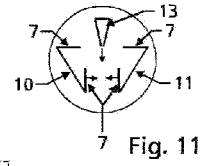
FIG. 11 illustrates the combining of the left and right sides with the plastic clip as shown also in FIG. 6 of the present invention.

FIG. 11 further illustrates the combining of the left and right side strips with the plastic clip as shown also in FIG. 6 of the present invention.

A kit for creating the artwork having multiple images thereon of the present invention has a left side medium for a left side image, a right side medium for a right side image, a coloring jig, a plurality of binder clips, a backing board frame, an instruction booklet, and a container for holding the above items. The media in the present invention is a left side die-cut sheet and a right side die-cut sheet, and the sheet is may be plastic, metal or preferably paper. Optionally, the kit may include die-cut sheets with images or no images thereon, and preferably complementary images. The instruction booklet may contain one or more examples of complementary images that an artist can paint upon the media, and the directions for constructing the artwork of the present invention. The example images may range from simple images to complex images so that children or adults can paint these images as appropriate.

The artwork of the present invention has a plurality of triangular prism shaped sections 40, the sections 40 being mounted adjacent to at least one other section 40, a left side and a right side strip 10 and 11 forming visible surfaces and joined at an apex of the triangular prism shaped section 40. The left side image is placed on the left side strips, and the right side image is placed on the right side strips resulting in composite image depending on a position of a viewer. The sections 40 having bottom sides composed of two tabs that are mounted to a backing board frame. The strips include at least one tab on each side of each strip. Each strip has a bottom tab and a top tab, the bottom tab is bent to a predetermined angle to the strip and parallel to a backing board frame; the top tab is bent to a predetermined angle to said strip and perpendicular to the backing board frame. The strips being mounted at a predetermined angle relative to the backing board frame with a predetermined angle of the strip ranging from abut 30 to about 60 degrees. A plastic binding clip is used to hold the top tabs together when gluing. The bottom tabs of the left and right side strip are attached to the backing board frame. Normally, the clips are removed after the sections are attached to the backing board frame.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An artwork, said artwork combining two images in a predetermined manner, said artwork comprising:

a plurality of triangular prism shaped sections, said sections being mounted adjacent to at least one other section, a left side and a right side strip forming visible surfaces and joined at an apex of said triangular prism shaped section, a left side image is placed on the left side strips, and the right side image is placed on the right side strips, a resulting composite image depends on a position of a viewer;

each triangular prism shaped section having a bottom side comprised of two bottom tabs, each being connected to a side strip; and a backing broad frame, said bottom tabs being capable of mounting to said backing broad frame.

2. The artwork as defined in claim 1, wherein said triangular prism shaped sections have said left side strip and said right side strip, said side strips further including at least one tab on each side of each strip, before fixedly attaching the strips together, each strip has said a bottom tab and a top tab, the bottom tab is bent to a predetermined angle to said strip and parallel to said backing board frame, the top tab is bent to a predetermined angle to said strip and perpendicular to said backing board frame, said strips being mounted at a predetermined angle relative to said backing board frame, said predetermined angle of said strip ranging from abut 30 to about 60 degrees.

3. The artwork as defined in claim 1, wherein the left side strip's top tab and the right side strip's top tab are capable of being affixed together.

4. The artwork as defined in claim 3 further including a removable clip capable of being attached to the top tabs.

5. The artwork as defined in claim 4 wherein said clip is substantially equal in length to said strip.

6. The artwork as defined in claim 1, further including a plurality of die-cut sheets having each image thereon, each strip of each die-cut sheet with tabs is capable of being separated by tearing along perforation lines between tabs, each tab is bent along a score line adjacent to said strip.

7. The artwork as defined in claim 1, wherein said sections are composed of flexible material such as plastic, metal, or paper.

8. A kit for creating artwork having multiple images thereon, said kit comprising:

a left side medium for a left side image, a right side medium for a right side image, a coloring jig, a plurality of clips, and a backing board frame.

9. The kit as defined in claim 8 wherein said left side medium is a die-cut sheet and said right side medium is a die-cut sheet.

10. The kit as defined in claim 9 wherein said sheets are paper.

11. The kit as defined in claim 9 further including a left side image on said left side die-cut sheet and a right side image on said right side die-cut sheet.

12. The kit as defined in claim 8 wherein said images are complementary.

* * * * *